US008958902B2

(12) United States Patent
Levine et al.

(10) Patent No.: US 8,958,902 B2
(45) Date of Patent: Feb. 17, 2015

(54) METHOD FOR MANAGING AND ELIMINATING FLOAT THREADS IN KNITTED GARMENTS

(71) Applicant: XOAB LLC, Boulder, CO (US)

(72) Inventors: Fredrick Ellis Levine, Boulder, CO (US); Neil Seth Levine, San Francisco, CA (US)

(73) Assignee: XOAB LLC, Boulder, CO (US)

( * ) Notice: Subject to any disclaimer, the term of this patent is extended or adjusted under 35 U.S.C. 154(b) by 0 days.

(21) Appl. No.: 14/195,131

(22) Filed: Mar. 3, 2014

(65) Prior Publication Data

US 2014/0257550 A1 Sep. 11, 2014

Related U.S. Application Data

(60) Provisional application No. 61/773,694, filed on Mar. 6, 2013.

(51) Int. Cl.

| | |
|---|---|
| ***G06F 19/00*** | (2011.01) |
| ***D04B 15/66*** | (2006.01) |
| ***D04B 1/26*** | (2006.01) |
| ***D04B 1/12*** | (2006.01) |

(52) U.S. Cl.

CPC *D04B 15/66* (2013.01); *D04B 1/26* (2013.01); *D04B 1/126* (2013.01)

USPC ..... 700/141

(58) Field of Classification Search

USPC ..... 700/141; 66/125 R, 133–135, 139, 66/140 R, 140 S

See application file for complete search history.

(56) References Cited

U.S. PATENT DOCUMENTS

| | | | | |
|---|---|---|---|---|
| 6,810,696 | B1 | 11/2004 | Lonati | |
| 7,272,462 | B2 * | 9/2007 | Smedley et al. | 700/141 |
| 2007/0156276 | A1 | 7/2007 | Smedley et al. | |
| 2008/0028800 | A1 | 2/2008 | Okamoto | |
| 2009/0089722 | A1 | 4/2009 | Lockman et al. | |
| 2009/0101051 | A1 | 4/2009 | Christman, Jr. | |

OTHER PUBLICATIONS

PCT International Search Report with attached Written Opinion of the International Searching Authority for International Application No. PCT/US2014/020322, dated Jun. 25, 2014, 9 pages.

* cited by examiner

*Primary Examiner* — Nathan Durham

(74) *Attorney, Agent, or Firm* — Dorr, Carson & Birney, P.C.

(57) ABSTRACT

A method for reducing the occurrence of float threads on the surface of a machine-knitted fabric. Beginning with an initial programmed pattern describing yarn used at each stitch in a knitting pattern, the present method identifies stitches that will create float threads, sorts the identified float threads, giving priority to those float threads that would most limit stretch in a knitted garment, taking into account factors such as float thread length, location in a garment and yarn stretch. Then, in order of the sorted float thread list, the present method assigns additional yarns of the same characteristics as the original yarns to available yarn feeds to minimize the eventual creation of float threads in the knitted fabric. Multiple passes are made through the programmed pattern until no additional floats can be mitigated, or until a predetermined number of passes has been completed.

15 Claims, 24 Drawing Sheets

ORIGINAL PATTERN

FIRST PATTERN ADJUSTMENT

SECOND PATTERN ADJUSTMENT

THIRD PATTERN ADJUSTMENT

ALGORITHMIC PATTERN ADJUSTMENT

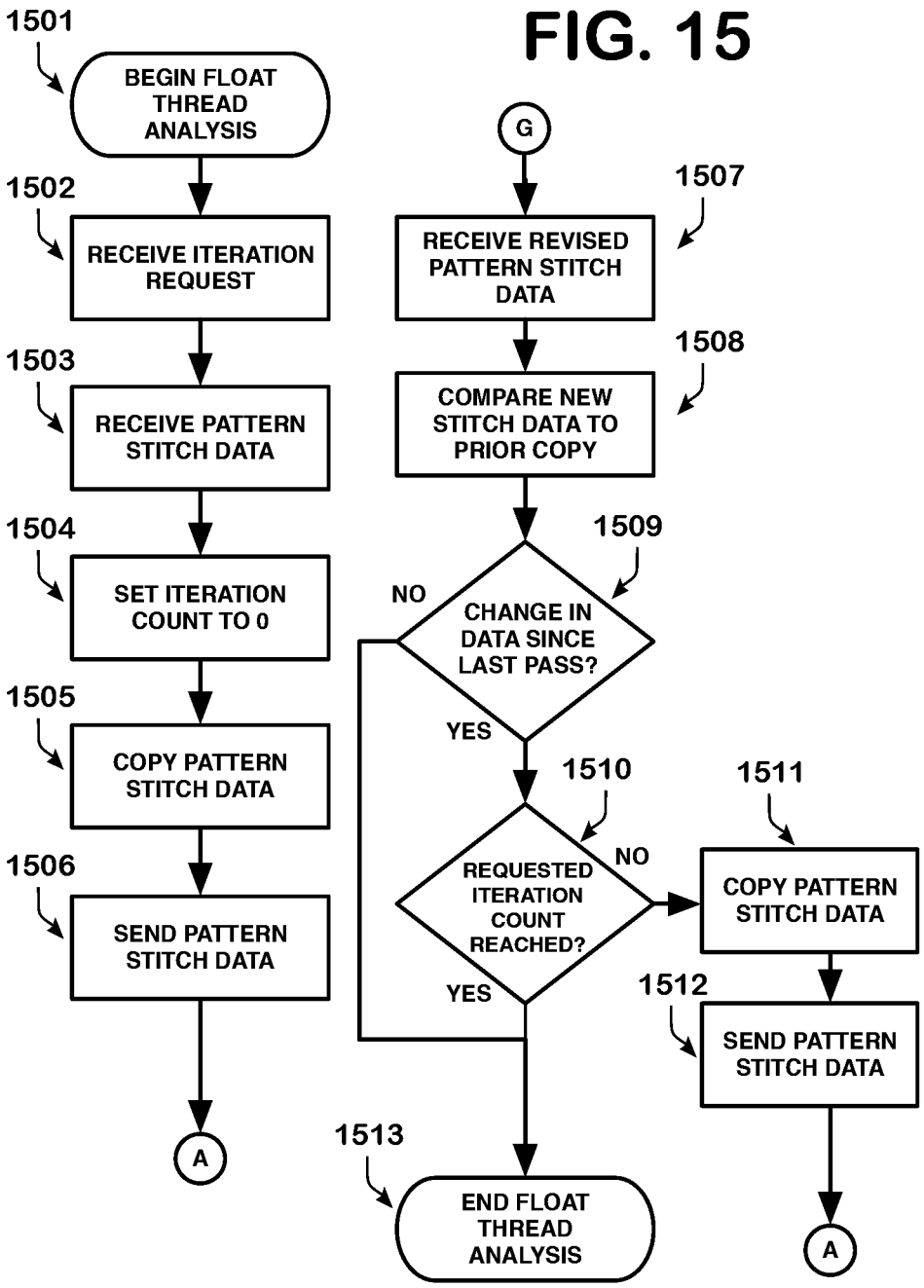
FIG. 15
1501
BEGIN FLOAT THREAD ANALYSIS
1502
RECEIVE ITERATION REQUEST
1503
RECEIVE PATTERN STITCH DATA
1504
SET ITERATION COUNT TO 0
1505
COPY PATTERN STITCH DATA
1506
SEND PATTERN STITCH DATA
A
G
1507
RECEIVE REVISED PATTERN STITCH DATA
1508
COMPARE NEW STITCH DATA TO PRIOR COPY
1509
CHANGE IN DATA SINCE LAST PASS?
NO
YES
1510
REQUESTED ITERATION COUNT REACHED?
NO
YES
1511
COPY PATTERN STITCH DATA
1512
SEND PATTERN STITCH DATA
A
1513
END FLOAT THREAD ANALYSIS

METHOD FOR MANAGING AND ELIMINATING FLOAT THREADS IN KNITTED GARMENTS

RELATED APPLICATION

The present application is based on and claims priority to the Applicant's U.S. Provisional Patent Application 61/773,694, entitled "Method For Managing And Eliminating Float Thread In Knitted Garments," filed on Mar. 6, 2013.

BACKGROUND OF THE INVENTION

1. Field of the Invention

The present invention relates generally to the field of machine-knitted garments. More particularly, the present invention is a method for reducing the occurrence of thread loops on the surface of machine-knitted fabric.

2. Background of the Invention

In machine-knitted garments, it is generally desired to cut the threads that would otherwise form loops on the reverse side of a knitted fabric, also called "float threads" or "floats." Float threads are created when knitting with multiple yarns, particularly when creating patterns with multiple threads in a plurality of colors. The presence of float threads reduces the degree to which a knitted garment can stretch, affecting the fit of the garment. In addition, the experience of donning or wearing a garment may be made uncomfortable as float threads can become caught on the fingers or toes of the person donning the garment.

In the hosiery industry, the lack of stretch in a knitted garment is of particular concern. Specifically for men's socks, the ability of the fabric to stretch adequately can be an issue, as men's sizes must stretch to accommodate men's larger diameter feet and legs. Historically, designers of men's socks have been limited in the range of designs they can attempt by the difficulty in implementing pattern complexity while preserving adequate stretch in the knitted fabric.

To further assist in understanding the problems associated with float threads, FIG. 1 illustrates an example of a knitting pattern 5. In particular, FIG. 1 shows a small segment of a knitted fabric 1 with a plurality of white and black thread loops. The thread loops may be represented in a diagram 2 as white and black squares. The white and black squares form a small portion of a bit-map image 3 and 4, which is a subsection of a graphic image used to represent an entire knitting pattern 5. In this hypothetical example, the knitting pattern 5 is a grid 200 squares wide by 530 squares high, each representing one stitch in the resulting knitted fabric.

FIG. 2 shows a small segment of a knitted fabric in more detail. The first thread 6 is used in the first row of the segment for four loops. A different color of thread 7 is introduced for the fifth and subsequent loops in the first row and the introduction of the thread 7 places a cut end 8 into the knitted fabric. Because the first color of thread 6 is not used again in the row, the knitting machine will eventually cut the thread 9 as it proceeds to knit the remainder of the row.

In the second row of the fabric segment in FIG. 2, a third color 10 has been introduced for the first loop shown. Another color 11 is introduced for the second loop, and continues, creating five loops. The color from the first loop is used again for the seventh loop 12. However, in this row, because the thread 10 was used for too few stitches, the knitting machine was unable to cut the thread, trapping float thread 13 across the reverse of the fabric.

FIG. 3 shows only a float thread, and the loop at either end of the float thread. When a stretching force 14 is applied to the fabric, thread is drawn through each loop 15 in the direction of the stretch. Thread from the far side of the loop 16 is drawn into the loop in response to the stretching force. However, if the thread is relatively inelastic, as is common in natural fibers such as wool or cotton, a float loop 17 is unable to yield to the stretching force, limiting stretch in that segment of the fabric. If a float loop spans more than one loop in a knitted fabric, for example the five loops spanned by float loop 13 in FIG. 2, then the loop extension that could have been contributed by the spanned loops does not occur, limiting the stretch extension of the fabric at the point where the float thread occurs.

In FIG. 4, a highly schematic top view of a typical circular knitting machine is shown, to demonstrate how float threads are created in a fabric. The knitting mechanism consists of a needle circle 18, surrounding a stationary dial cap 19. Below the dial cap is a rotating dial (not visible) to which is fixed an annular saw ring 20 that is toothed about its periphery to provide a series of teeth 21 terminating in cutting edges. Surrounding the needle circle 18 is a latch ring 22. In accordance with the usual practice, the needle cylinder and dial cap are rotated and yarns are placed into and withdrawn from action by the conventional feed, finger and pattern mechanism (not shown) including a computer controller and electronic actuators. Operation of the knitting machine is controlled by the computer in accordance with a pattern programmed by the user. This programmed pattern specifies the operating parameters for the knitting machine, including the yarn feeds to be used in each thread loop for each row of the pattern as discussed above, to result in production of knitted fabric having the desired graphic pattern by the knitting machine.

A cutter mechanism is provided to sever a feed yarn from its source after the end of the yarn has been knitted into the fabric. A typical cutter mechanism includes a flat spring element 23 mounted at one end on a bracket 24 that, in turn, is secured above the rotating saw ring 20. The flat spring element 23 extends circumferentially and at its free extremity terminates in a downturned leg 25 riding on the upper surface of the toothed ring 20. In normal operation, familiar to those conversant in the art of circular knitting, the cutter mechanism cooperates with the toothed ring 20 to sever the yarn engaged over the cutting edges of saw teeth 21.

Continuing with FIG. 4, needle 27 engages an active yarn 26. Subsequent needles miss the yarn 26 until it is reengaged by the needles after needle 28. The angle 29 between needle 27 and needle 28 is small enough that the chord of the knitting circle described by the un-knitted yarn does not pass under the downturned leg 25 of the cutter mechanism and a float thread 30 is created.

In a typical circular knitting machine, the angle 29 and therefore the minimum number of needles that must be skipped to avoid creating float threads are constants. In the example of FIG. 4, eighteen needles must be skipped, one needle more than the distance spanned by thread 30, before a yarn feed is reintroduced, in order for a thread loop to pass under the cutter leg 25, avoiding the creation of a float thread. Any reintroduction of a yarn from a single feed finger before the required minimum number of needles has passed will result in the creation of a float thread in the knitted fabric.

FIG. 5 presents a representation of the graphic pattern 31 for a sock. If a sock is knitted using the pattern, the sock must be turned inside out to see the float threads on the inner surface of the fabric. A visual representation or map of the float threads 32 may be created by representing each float thread as a line of pixels in a drawing, in the same way as in FIG. 1, where sequences of pattern loops 1 are represented by drawing pixel elements in 3 and 4. The map 32 presents the float threads as they will be seen when the sock is turned inside out. It is easier for a designer to understand the specific pattern features that create float threads in a pattern if a float map 33 is presented in the same orientation as the pattern image 31, rather than as seen when the sock is turned inside out. In FIG. 6 through FIG. 10, all float diagrams will be presented in the same orientation as the original pattern.

FIG. 6 is a diagram of a simple sock pattern image 34, a visual map of float threads 35 that would be created if the pattern 34 is knitted, and a histogram chart 37 that provides an indication to a designer or machine operator of where float threads will occur in the knitted sock. The histogram chart 36 has an indicator line 37, labeled with a percentage "45" to indicate that 45% of the stitches in the sock are covered by float threads. In addition, the histogram indicates the percentage of each course of the sock covered by float threads. Three histogram peaks 38 indicate three areas in the sock that will have a majority of the stitches covered with float threads, and consequently the stretch in the sock fabric will be greatly reduced in those areas. Any person skilled in the art will recognize that the methodology for generating the float thread histogram 36 can show numeric stitch percentages or can be used to display more sophisticated measures of stretch reduction, taking into account various factors, such as the length of individual float threads or the stretch characteristics of specific types of yarn.

FIGS. 7-9 present the pattern from FIG. 6, as it may be altered in successive steps by a machine operator or designer in an attempt to reduce float threads in a fabric. Each step of this process requires the operator to create a modified pattern file for the knitting machine, load the file into the machine and knit a physical sock in order to evaluate the success of their pattern modifications. In FIG. 7, the operator may add a second feed for the pattern yarn, represented by a new color 39 in the pattern. The easiest approach, and the one followed by most machine operators and designers, is to replace entire shapes in the pattern with a color from the new yarn feed 39. The average float thread coverage 40 is reduced to 31%, but there are still peaks 41 in the histogram with substantial float coverage. In FIG. 8, the operator introduces a third yarn feed 42 for the pattern color, and sees a reduction in the average float coverage 43 to 27%, with some reduction in the histogram peak 44. In FIG. 9, the operator, having exhausted the easy pattern shapes to replace, has introduced a new yarn feed 45 to replace some areas of the ground color in the pattern. The float thread histogram shows a reduction in float coverage to 10% at 46 with peaks 47. However, at this point many operators will cease their efforts to eliminate floats, as the process has consumed four prototyping passes and considerable time.

The prior art in the field includes a number of other approaches to reducing the number of float threads. For example, U.S. Pat. No. 6,810,696 (Lonati) describes a method for automatically setting up the pattern thread feed units on a circular knitting machine to enable more float thread loops to be cut. The method described begins at the top of a knitted garment, and proceeds row by row to the end of the garment.

However, in a real-world production environment, it is quite possible for a simple automated methodology to require more thread feeds than are available on a specific knitting machine, leaving many threads uncut. In practice, it is very easy to create multicolor patterns requiring more thread feeds than are available on a knitting machine. When prior-art methodologies fail, they may do so in such a way as to leave much of the garment with an untenable number of float threads, and inadequate stretch in the garment fabric. In instances where prior-art methodologies fail to deliver adequate reduction in float threads, practice has shown that there is a need for highly-skilled manufacturing personnel to make decisions to simplify or modify the pattern design, or to collaborate with design staff to make such decisions.

Unfortunately, without adequate means to visualize the end result of the float reduction process and a means to quantify and predict the effects of reduction in uncut float stitches on fabric stretch, staff in both design and manufacturing departments must employ costly trial-and-error repetition of knitting tests in their attempts to correct float problems, an outcome the inventors of the prior methodologies in this field recognized and were explicitly attempting to avoid. Furthermore, in an environment where manufacturing is often conducted at considerable geographical remove from the original designer of a garment, the needed collaboration is at best time-consuming and at worst impossible to achieve, resulting in severe limits being placed on the range of designs considered for production.

Thus, conventional attempts at design optimization by a human operator have the shortcomings of being time-consuming and expensive. In addition, this type of optimization is limited by the skill of the human operator and the limited amount of time and effort that can be devoted to any particular job. Therefore, a need exists for a computer-based method for analyzing and reducing the occurrence of float threads by creating a sorted list of float threads over the entire fabric design, and then assigning available yarn feeds to minimize the creation of float threads in the knitted fabric.

SUMMARY OF THE INVENTION

This invention provides a method for analyzing and reducing the occurrence of float threads on the surface of a machine-knitted fabric. Beginning with an initial programmed pattern describing yarn used at each stitch in a knitting pattern, the present method identifies stitches that will create float threads, sorts the identified float threads, giving priority to those float threads that would most limit stretch in a knitted garment, taking into account factors such as float thread length, location of the float thread in a garment, and the stretch and material characteristics of the yarn involved. Then, in order of the sorted float thread list, the present method modifies the programmed pattern to assign additional yarns of the same characteristics (e.g., color and material) as the original yarns to available yarn feeds to minimize the eventual creation of float threads in the knitted fabric. Multiple passes are made through the programmed pattern until no additional floats can be mitigated, or until a predetermined number of passes has been completed.

It is an object of the present invention to provide an automated method for analyzing and reducing float threads in knitted fabrics.

Another object is to provide a method to prioritize cutting the longest float threads in a garment before shorter float threads, rather than proceeding in a linear, row by row fashion from the top of the garment, as longer float threads cause a greater reduction in fabric stretch than shorter float threads.

A further object is to provide a method to prioritize the reduction of float threads in critical areas of a garment needing the most stretch, rather than proceeding in a linear fashion from the top of the garment, allocating limited knitting machine feed resources in a way that maximizes fabric stretch.

Yet another object is to provide direction to a machine operator to change the yarn threading of a knitting machine so as to reduce or eliminate float threads in fabric knitted by that machine.

Still another object is to provide visualization and predictive tools to help machine operators and designers of garments understand how changes to a knitted pattern will affect the float threads and fabric stretch in a garment.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 15 through FIG. 20 provide a flowchart of an embodiment of the present invention.

DETAILED DESCRIPTION OF THE INVENTION

In general terms, the present invention provides a method for reducing the occurrence of float threads in knitted fabric produced by a computer-controlled knitting machine. Conventionally, the pattern of the knitted fabric produced is controlled by a programmed pattern in which yarns having specific characteristics in the fabric pattern are assigned to each of a set of yarn feeds. However, a number of the available yarn feeds are typically left unassigned.

The present method initially builds a list of float threads from the programmed pattern, and prioritizes this list of float threads based on a number of factors. For example, the list can be prioritized based on the length of each float thread, the location of the float thread within the knitted fabric, the stretch characteristics of the yarn, or the yarn material. The program pattern is then modified, based on the order of the prioritized list, to assign at least one unassigned yarn feed to use an existing yarn in the fabric pattern to thereby reduce float threads.

Preferably, additional yarn feeds are assigned one at a time, and the prioritized list of float threads is rebuilt following assignment of each additional yarn feed. This can be accomplished iteratively by: (1) rebuilding the list of float threads from the modified programmed pattern; (2) prioritizing the list of float threads based on predetermined factors, and then (3) modifying the programmed pattern based on the order of the prioritized list of float threads to assign an additional unassigned yarn feed to use an existing yarn in the fabric pattern. These steps can be repeated until no additional float threads can be mitigated (e.g., no float threads remain, or no unassigned yarn feeds remain), or until a predetermined number of iterations have been completed.

More specifically, FIGS. 15-20 provide a flowchart of one embodiment of the present methodology for reducing float threads. As a general overview, the present invention identifies stitches in the programmed pattern for the knitted fabric that will create float threads, and sorts the identified float threads, giving priority to those float threads that would most limit stretch in a knitted garment, taking into account factors such as float thread length, location in a garment and yarn stretch. Then, in order of the sorted float thread list, the present method modifies to programmed pattern to assign available yarn feeds to use additional yarns in the same color as the original yarns in the fabric to minimize the creation of float threads in the knitted fabric. Multiple passes are made through the programmed pattern until no additional float threads can be mitigated, or until a predetermined number of passes has been completed.

Figure 10:
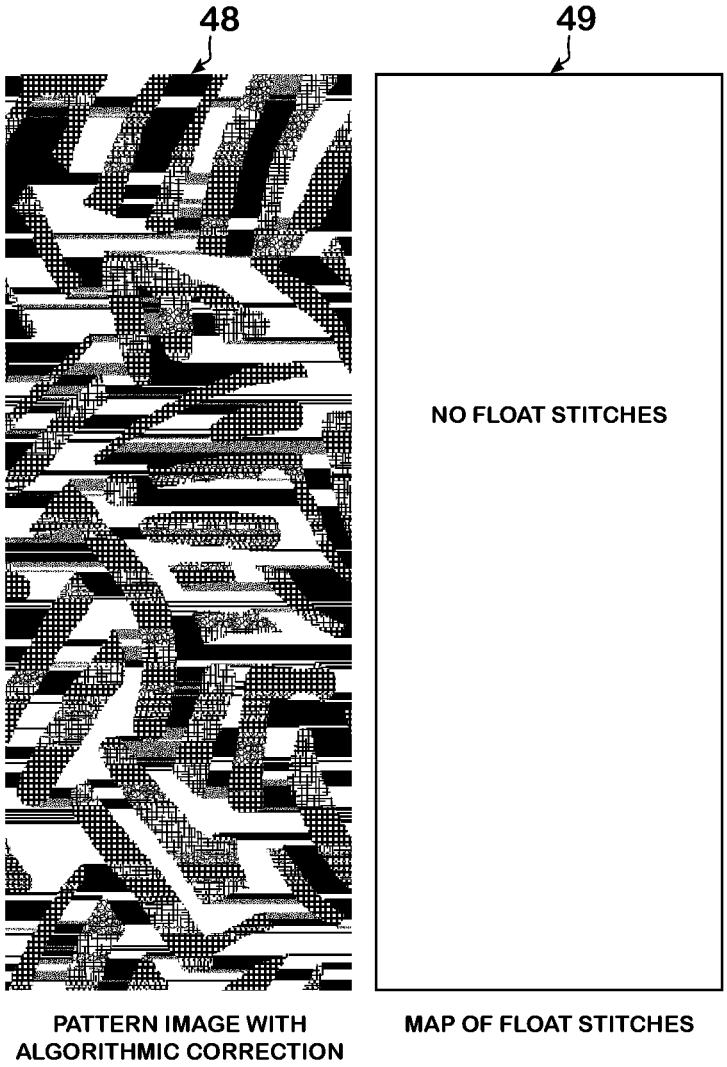
FIG. 10 is a diagram illustrating the elimination of float threads in the pattern of FIG. 6 by the present invention.

FIG. 10 shows an example of a pattern 48 resulting from a float thread reduction as performed by the present method. Rather than replacing entire shapes in the pattern, portions of individual courses are replaced with new yarn feeds, and a larger plurality of feeds, represented by additional cross-hatchings, are used in the solution. In this example, the float map 49 indicates no float stitches will be created when the sock is knitted.

Figure 12:
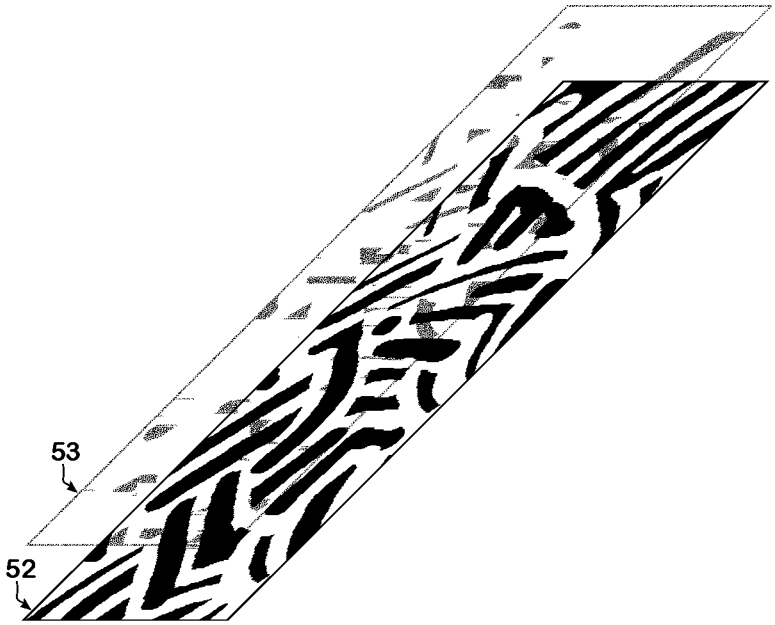
FIGS. 12 and 12A are diagrams illustrating a visualization technique for previewing where float threads occur in a knitted fabric.
Figure 12A:
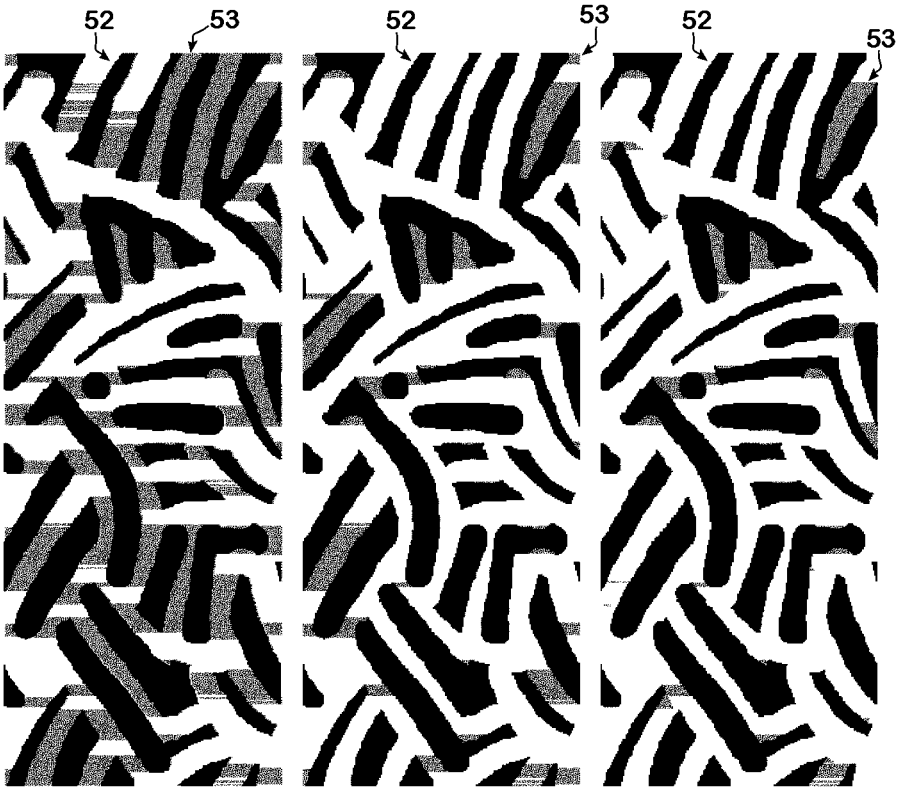

The present invention can also be employed to create the visualizations and the data underlying the diagrams shown in FIGS. 7-10. In order to increase the productivity of designers and machine operators it is also possible to overlay a semi-transparent version the float map 53, as shown in FIG. 12, over the pattern diagram 52 to provide an immediate visual indication of the specific stitches creating float threads. In FIG. 12A, a series of three views of the pattern diagram is shown, with successive versions of the float overlay 53 showing fewer float threads in each step, reflecting a sequence of manipulations of the underlying pattern diagram. Those conversant in the art of programming computer graphics interfaces will understand it is possible to create an overlay simulation of float threads caused by a pattern, and change the overlay display interactively, to show a designer or machine operator the consequences of their manipulation of a pattern file as regards the generation of float threads in a fabric.

To arrive at the data for a modified pattern with no float threads exemplified by the pattern 48 shown in FIG. 10, the present invention creates a stitch-by-stitch analysis of the stitch and yarn feed data for a patterned fabric. The data used for the analysis can be represented as shown in two hypothetical examples, the first in FIG. 13 and FIG. 13A and the second in FIG. 14. Subsequent drawings FIG. 15 through FIG. 20 present a flow chart of the analysis process.

Figure 13:
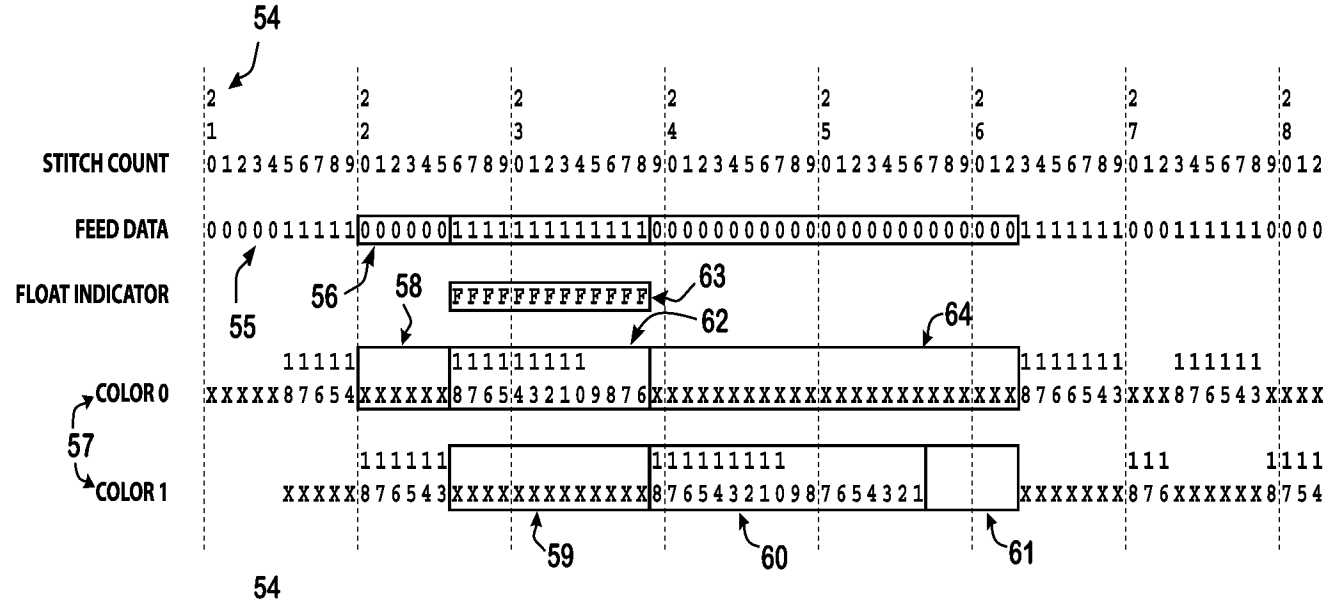
FIGS. 13, 13A and 14 are diagrams illustrating the data model for the invention.
Figure 13A:
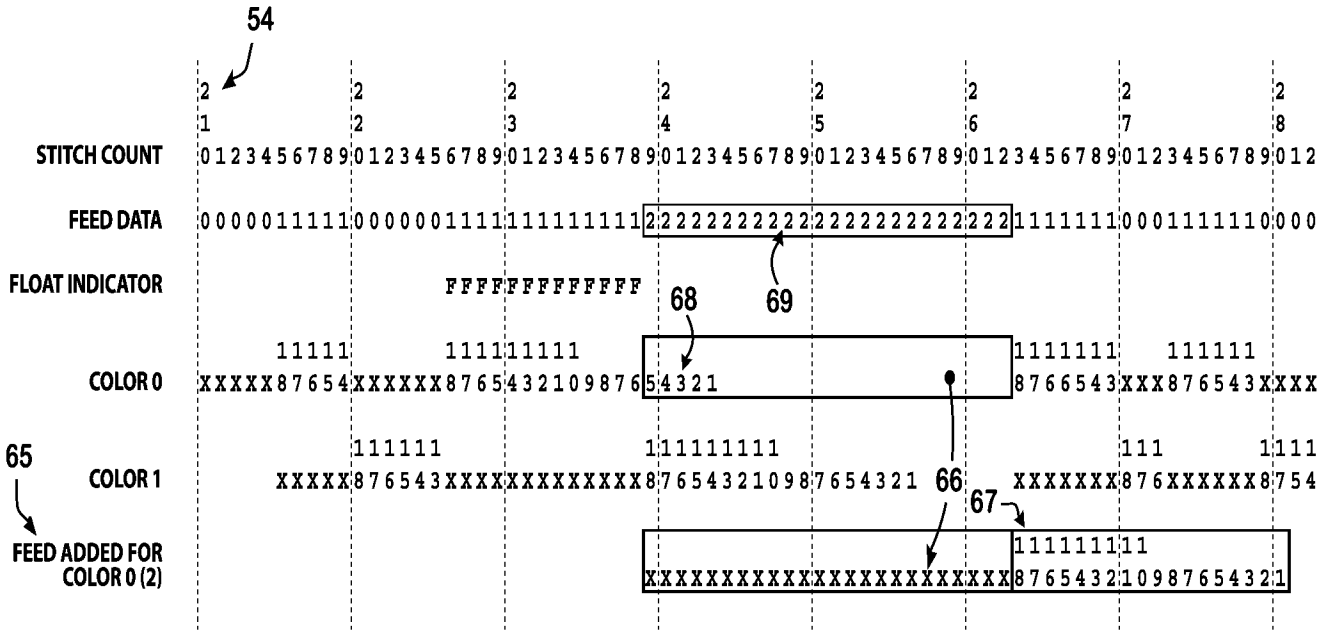

In FIG. 13 and FIG. 13A, a stitch count scale 54 is provided for ease of reference and calculation, showing stitches 210 to 282 of many tens or hundreds of thousands of stitches in a garment. Feed data 55 from a pattern file is shown for each stitch, with a unique numeric or alphabetic character representing each yarn feed. In this example, two feeds are employed in the original pattern, represented in feed data 55 by 1's and 0's.

Figure 1:
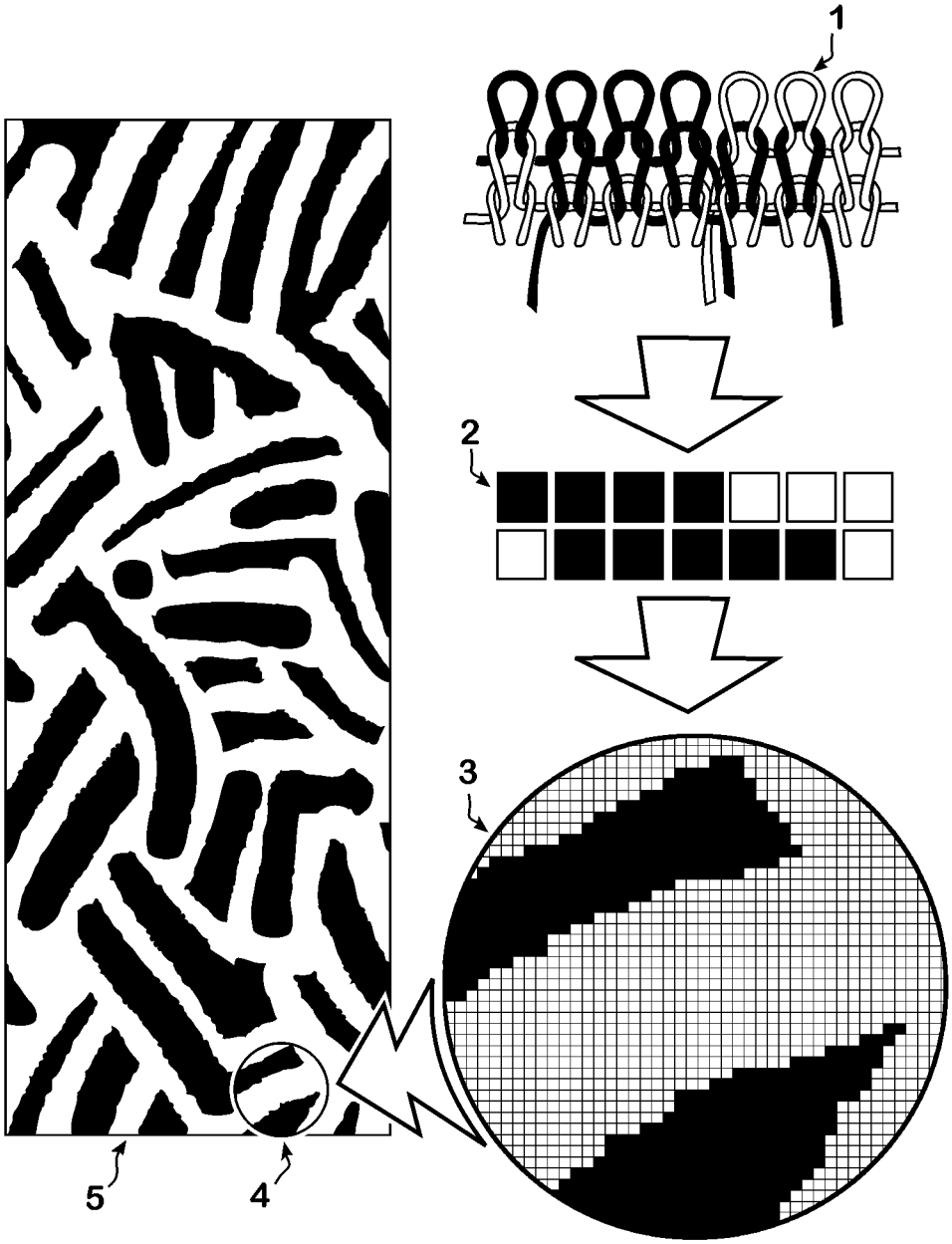
FIG. 1 is a diagram illustrating the relationship between a simplified, hypothetical knitted fabric and a printed image of the pattern from which that fabric is knitted.
Figure 2:
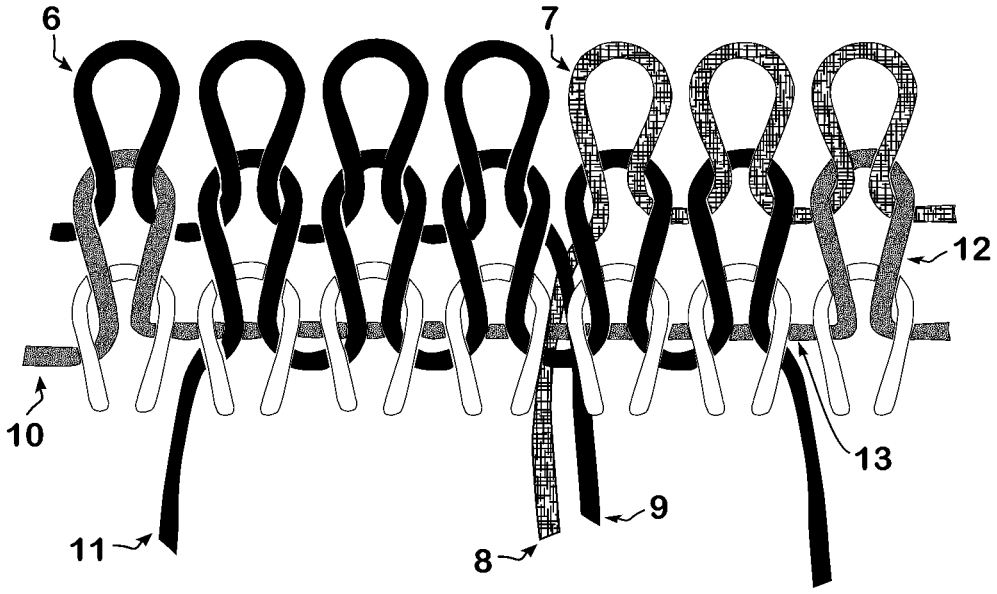
FIG. 2 is a diagram illustrating a float thread in a hypothetical knitted fabric.
Figure 3:
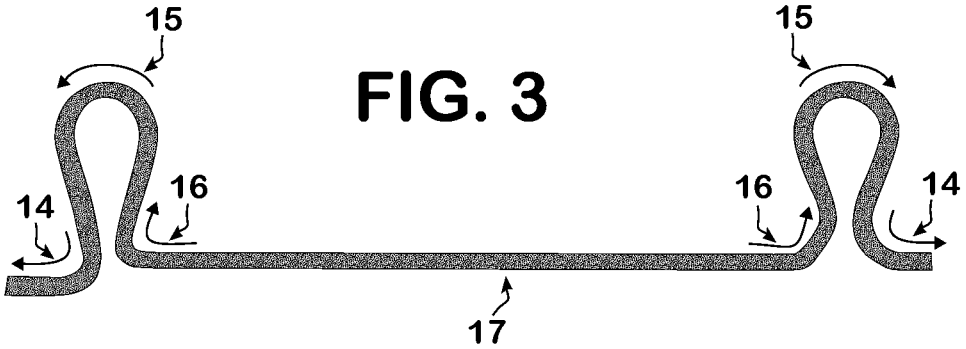
FIG. 3 is a diagram illustrating how a float thread will limit stretch in a fabric.
Figure 4:
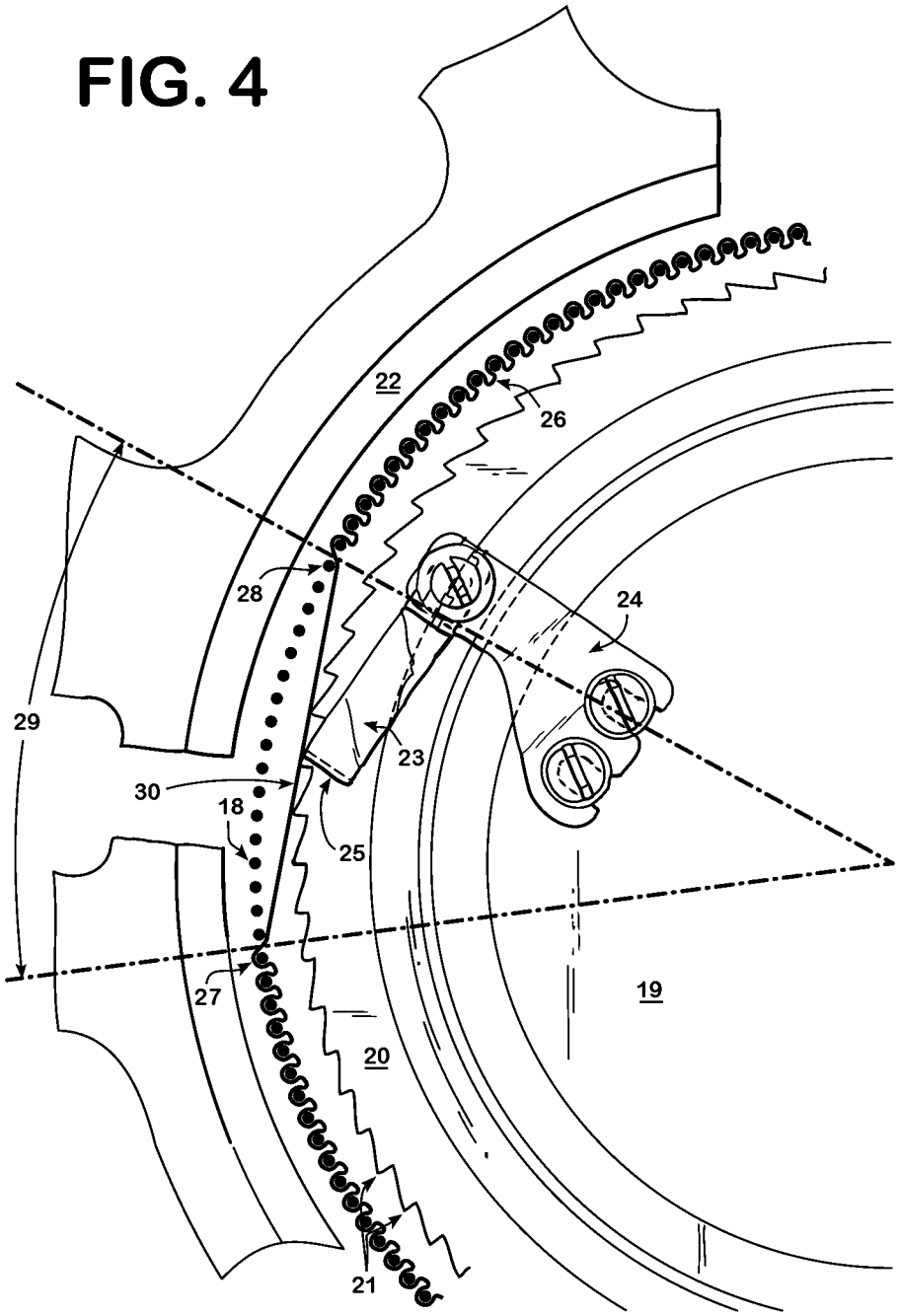
FIG. 4 is a simplified top view of a hypothetical circular knitting machine, showing only those components necessary to explain the formation of float threads.
Figure 5:
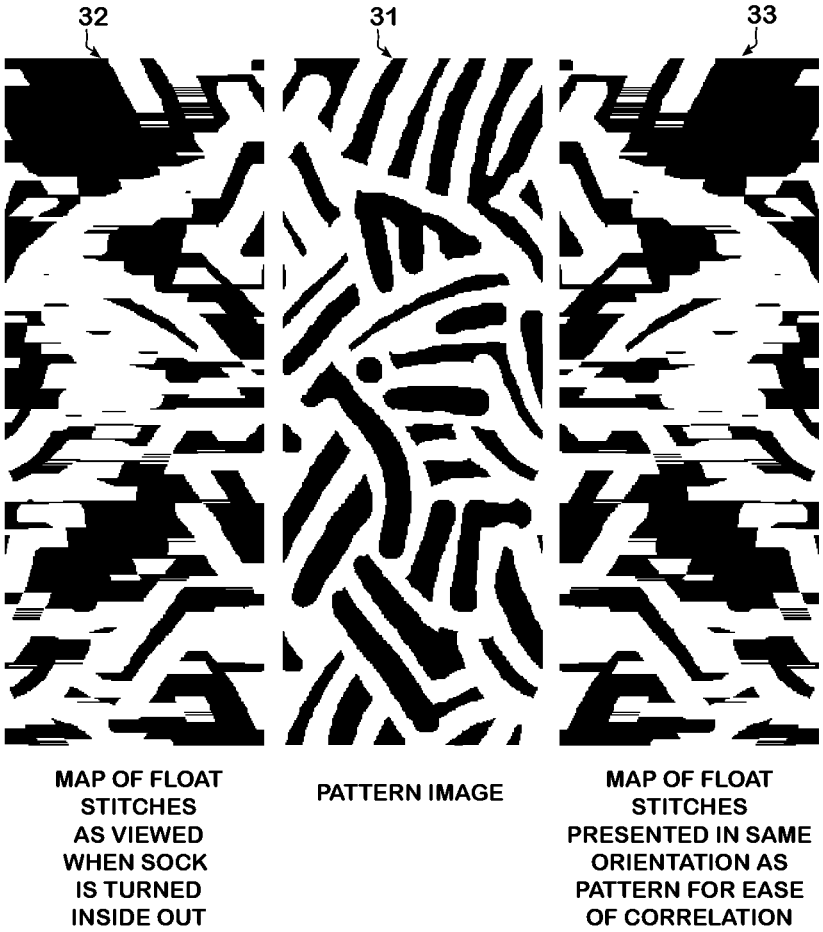
FIG. 5 is a diagram illustrating how float threads may be shown in a visual representation.
Figure 6:
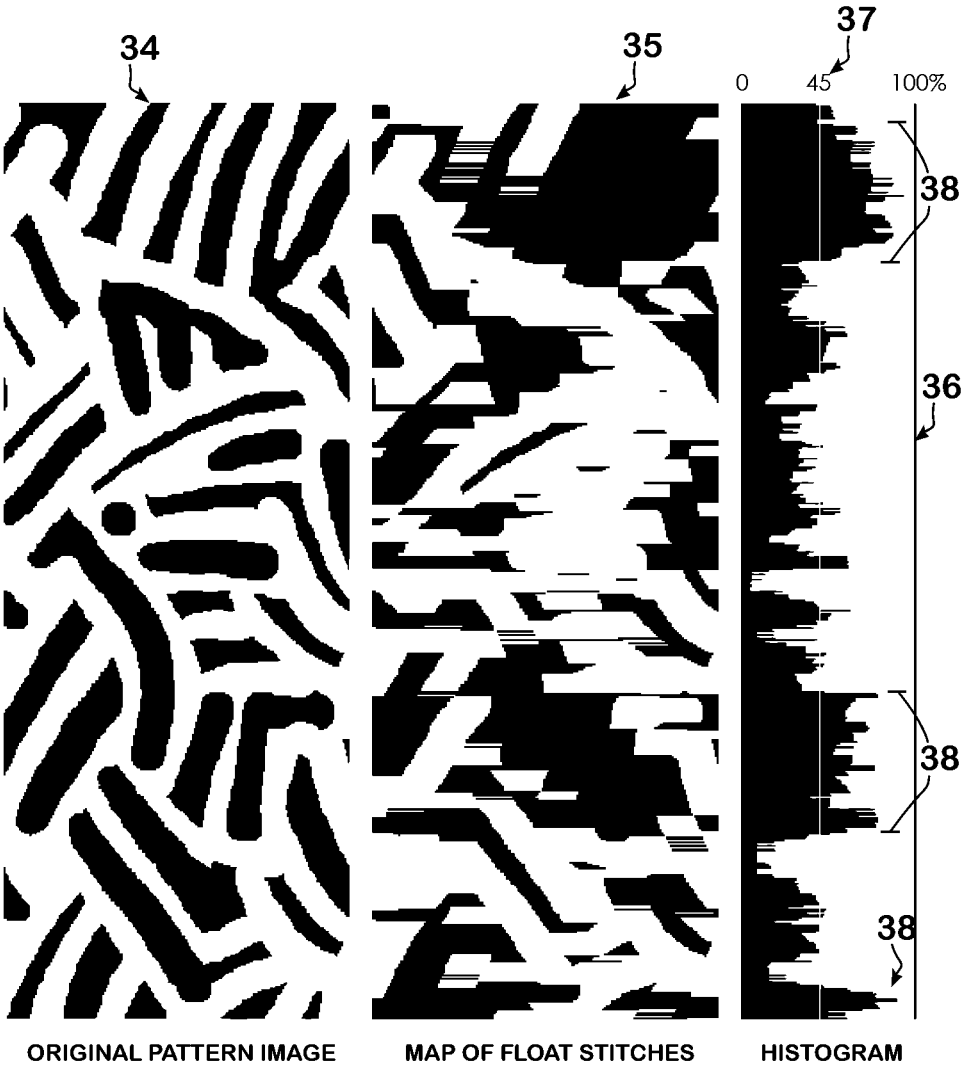
FIG. 6 is a diagram illustrating a hypothetical knitting pattern and the float threads formed when that pattern is knitted.
Figure 7:
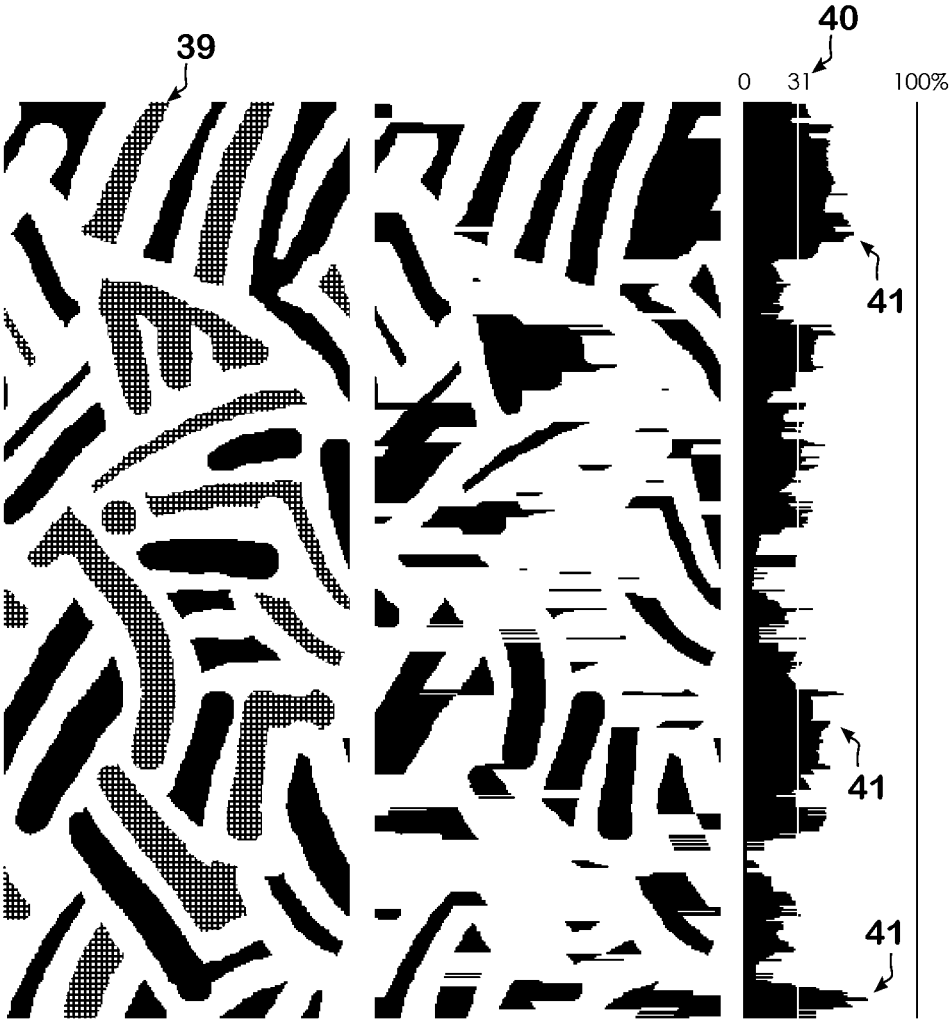
FIG. 7 through FIG. 9 are diagrams illustrating how a designer can attempt to correct float threads in the pattern of FIG. 6 by trial and error.
Figure 8:
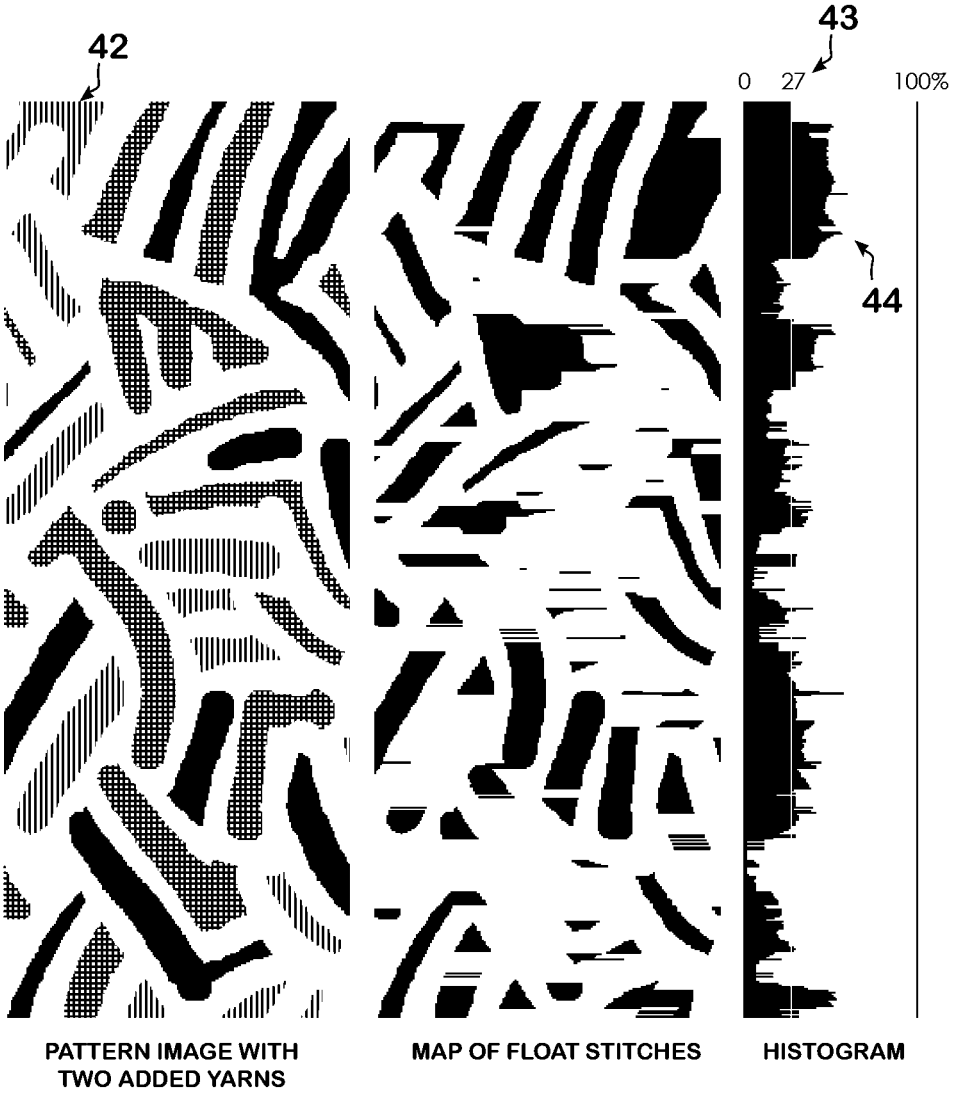
Figure 9:
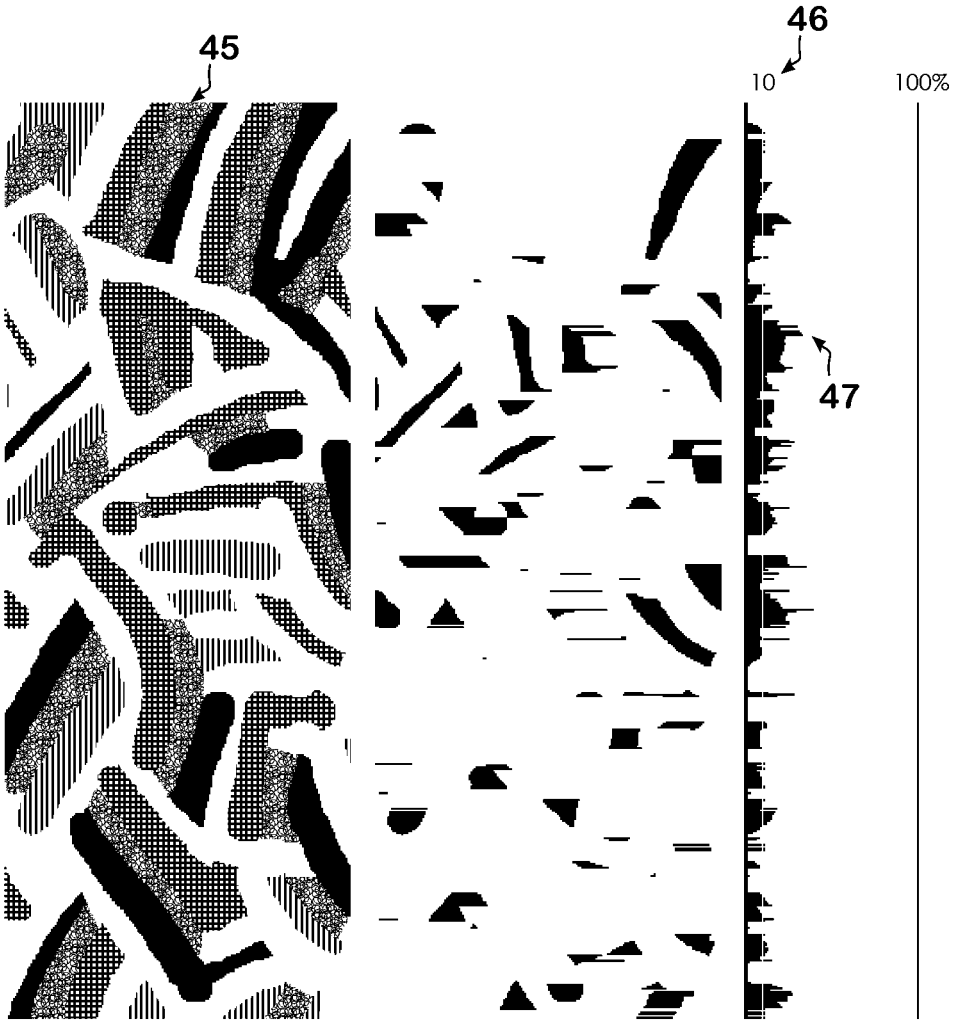

For the calculation of float threads in both examples, a minimum feed reintroduction spacing of 18 needles is used, as discussed in the explanation of FIG. 4. In the preferred embodiment of the present invention, an analysis is made of all stitch data, marking those stitch sequences producing float threads in the finished garment.

For example, feed data sequence 56 has six stitches of feed 0, starting at stitch 220, 13 stitches from feed 1, starting at stitch 226 and continuing until stitch 238, followed by 24 stitches of feed 0 from stitch 239 until stitch 262. Because only 13 stitches occur between the last use of feed 0 in this sequence 56 at stitch 225 and the resumed use of feed 0 at stitch 239, feed 0 will create a float thread from stitch 226 until stitch 238. A float indicator 63 denotes the float thread.

Continuing with FIG. 13, the present method creates data representations 57 of the stitch usage of each yarn feed, labeled "COLOR 0" and "COLOR 1". The initial six stitches of feed 0 in feed data sequence 56 are represented 58 by the character "X" in the stitch usage for COLOR 0 as are the subsequent stitches 59 of COLOR 1.

Immediately following the stitches 58 of COLOR 0 is a countdown sequence 62 beginning at 18 (the minimum needle feed reintroduction spacing in this example) and continuing to 6. Because 18 needles are not unused by feed 0 before reintroduction at stitch 239, the countdown 62 stops at 6, also indicating that a float thread will be created when the fabric is knitted.

In contrast, the countdown sequence 60 following COLOR 1 stitches 59 concludes at 1, and is followed by six needles 61 where the COLOR 1 is not used in the fabric, from stitch 257 to stitch 262, indicated by blank spaces in the data. A float thread will not be created by COLOR 1 starting at stitch 239.

To correct the stitch data causing the float thread in FIG. 13, the stitches knitted by feed 0 64 must be moved to another feed using the same color. In FIG. 13A, this process is shown. A new color feed for COLOR 0 65 is added to the data structures by the present method. X's representing stitches are removed 66 from COLOR 0 data and placed in the new feed. A countdown sequence 67 is placed in the new feed from stitch 263 to 280. The countdown of COLOR 0 is completed 68, and the "0" characters in the feed data are replaced by "2" characters 69 to indicate the stitch counts where the new feed is used in the pattern.

Figure 14:
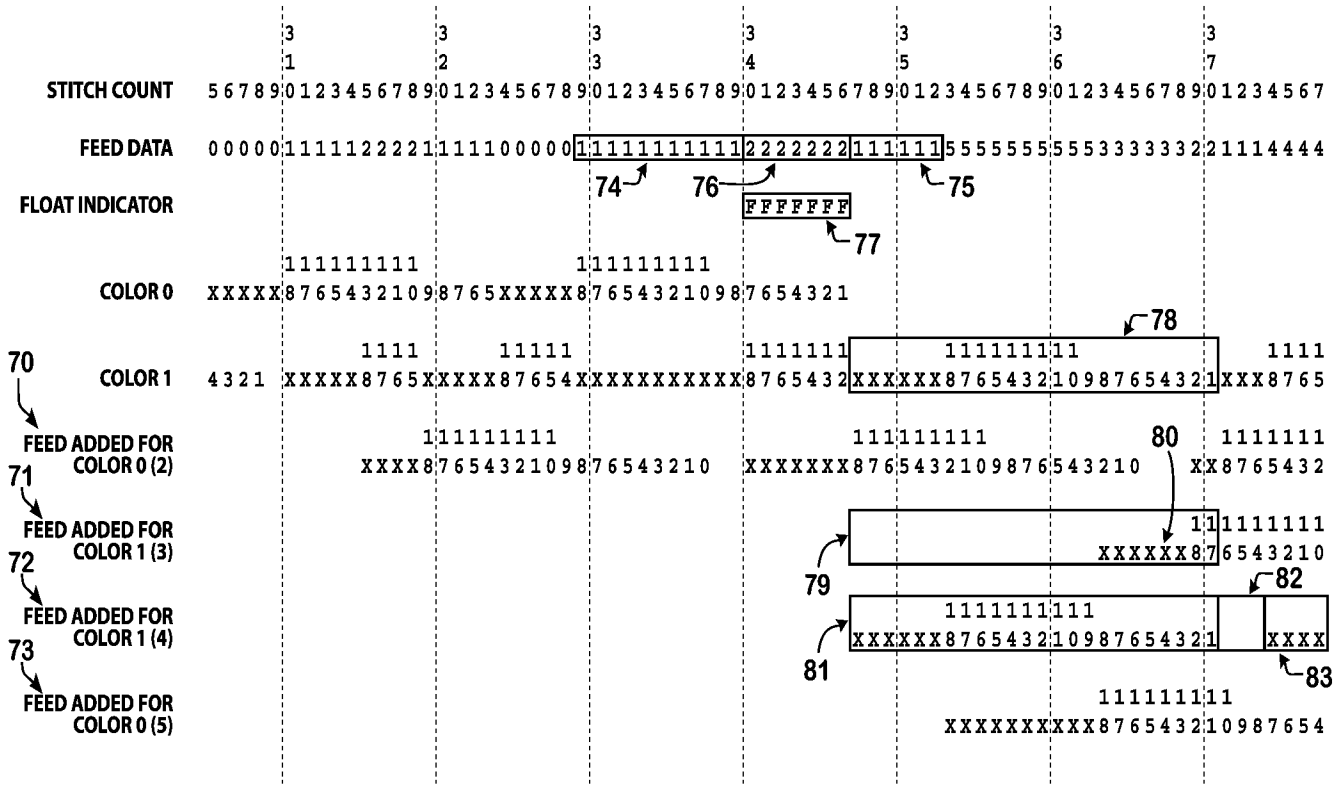

The second data example is illustrated in FIG. 14. In this drawing, the present method has already added four additional yarn feeds to pattern, two for COLOR 0 70, 73 and two for COLOR 1 71, 72. In this example, the feed data sequence creating the float thread has 11 stitches of feed 1, 74 starting at stitch 329, 7 stitches from feed 2 76, starting at stitch 340 and continuing until stitch 346, followed by 6 stitches of feed 1 75 from stitch 347 until stitch 352. Because only 7 stitches occur between the last use of feed 1 in this sequence at stitch 339 and the resumed use of feed 1 at stitch 347, feed 0 will create a float thread from stitch 340 until stitch 246. A float indicator 77 denotes the float thread. To eliminate the float thread caused by feed 1, the present method must move the seven stitches of feed 1 75 to another feed, allowing room after the last stitch of feed 1 for an 18-needle countdown window, or a total length of 24 needles 78.

The present method examines both of the additional feeds already added for feed 1. The first additional feed 71, does not have room for the entire countdown sequence, colliding with stitches already placed in the feed at stitch 364 80. The second feed added for feed 1, 72, has adequate space for the stitches and countdown window 81. There are three unused needles, starting at stitch 371 82, before the feed is used for a previously moved stitch sequence 83. In a similar fashion to the example illustrated in FIG. 13A, the present method will move the feed 1 stitches to the new feed, add a countdown sequence in feed 1 and update the feed numbering in the feed data to reflect the new feed usage.

One embodiment of the present method is documented in a flowchart, the beginning of which is illustrated in FIG. 15. This embodiment of the present method begins the analysis of float threads at step 1501. In step 1502, the present method receives a request for multiple iterations on the pattern stitch data received in step 1503. The pattern stitch data is similar to that shown in FIG. 13A, 55, with one character provided per stitch in a fabric. Each yarn feed used in the pattern is represented by a unique identification character, not representing any other yarn feed. The present invention can receive the pattern stitch data and the desired number of iterations from such external sources, not shown here, as will be familiar to those skilled in the art of computer data processing.

In preparation to commencing analysis of the stitch data, this embodiment of the present invention initializes an iteration counter in step 1504 and creates a copy of the pattern stitch data in step 1505 to use in future comparisons, and sends the original data onward to the next module.

Figure 16A:
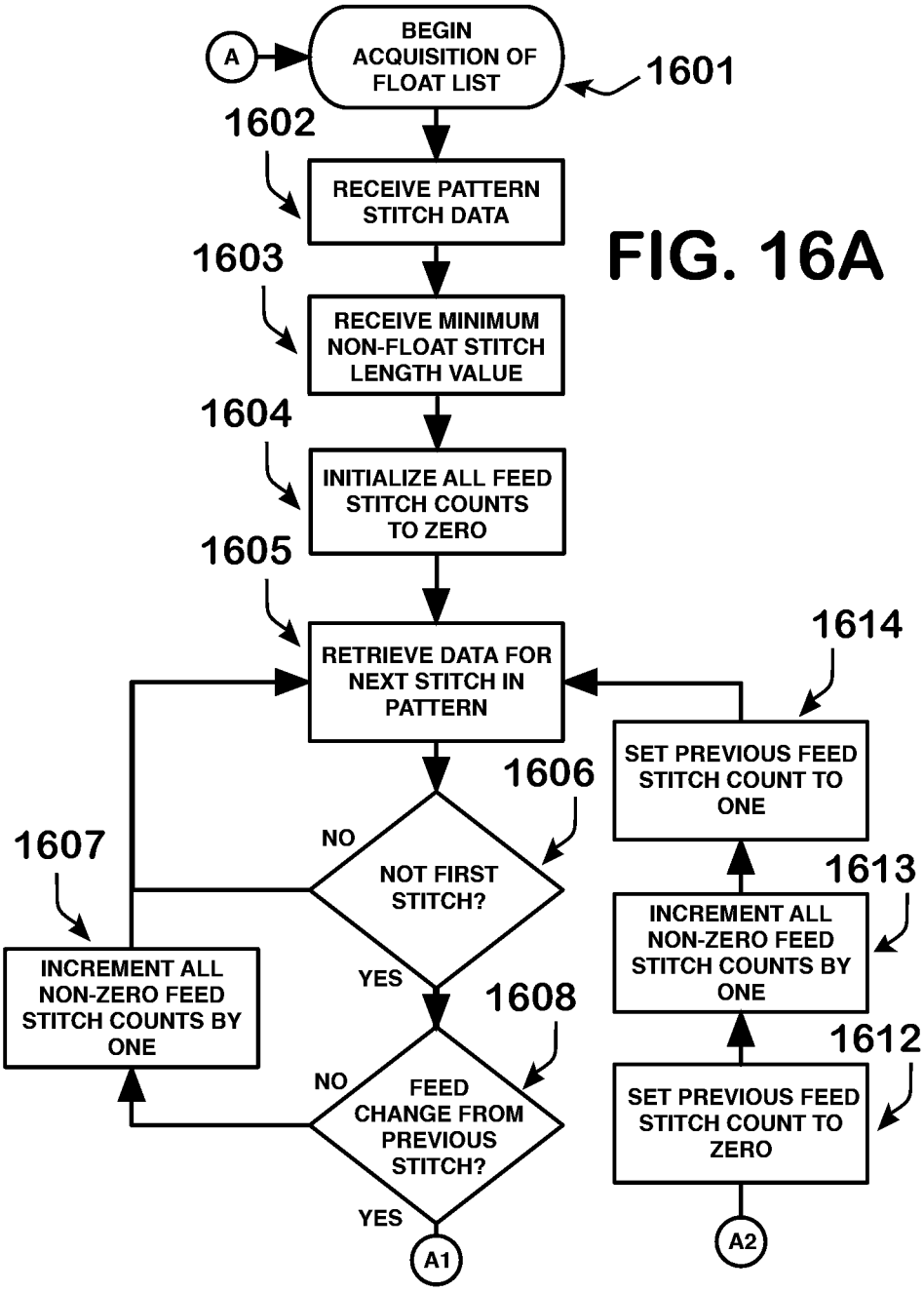

In FIG. 16A, the process of acquiring a list of float threads 1601 begins with the receipt of the pattern stitch data in operation 1602 and the receipt of a fixed value for the minimum number of needles required for a feed to be inactive to avoid creating a float thread in step 1603, as discussed in the explanation of FIG. 4. The present method initializes a stitch counter for each feed in step 1604 and begins its main loop, examining the stitch data for the first stitch in the pattern in step 1605. If the stitch examined is not the first stitch in the pattern, decision operation 1606 will continue, otherwise it will branch back to step 1605 to retrieve the next stitch. Decision operation 1608 evaluates whether or not the feed used in the current stitch is different than the feed used in the previous stitch. If it has not changed, all non-zero feed stitch counts are incremented by one in step 1607 and the information for the next stitch is retrieved by operation 1605. Continuing to FIG. 16B, if the feed has changed from the previous stitch, decision operation 1609 in FIG. 16B evaluates the stitch count for the previous stitch. If the count is zero, the feed has not been used before. If the count is greater than the float minimum, the previous yarn feed will not create a float thread. In either case, decision operation 1609 evaluates to "yes." Decision operation 1611 will check if the current stitch is the last stitch in the pattern, and will end acquisition of the float list 1616 after sending the pattern stitch data and float list to next process. If the current stitch is not the last stitch in the pattern, decision operation 1611 will branch to "no." Returning to FIG. 16A, the previous feed stitch count will be set to zero 1612, all non-zero feed stitch counts will be incremented by one in step 1613, the previous feed stitch count will be set to one in step 1614, and execution will return to step 1605 in FIG. 16A to retrieve feed data for the next stitch in the pattern.

Figure 16B:
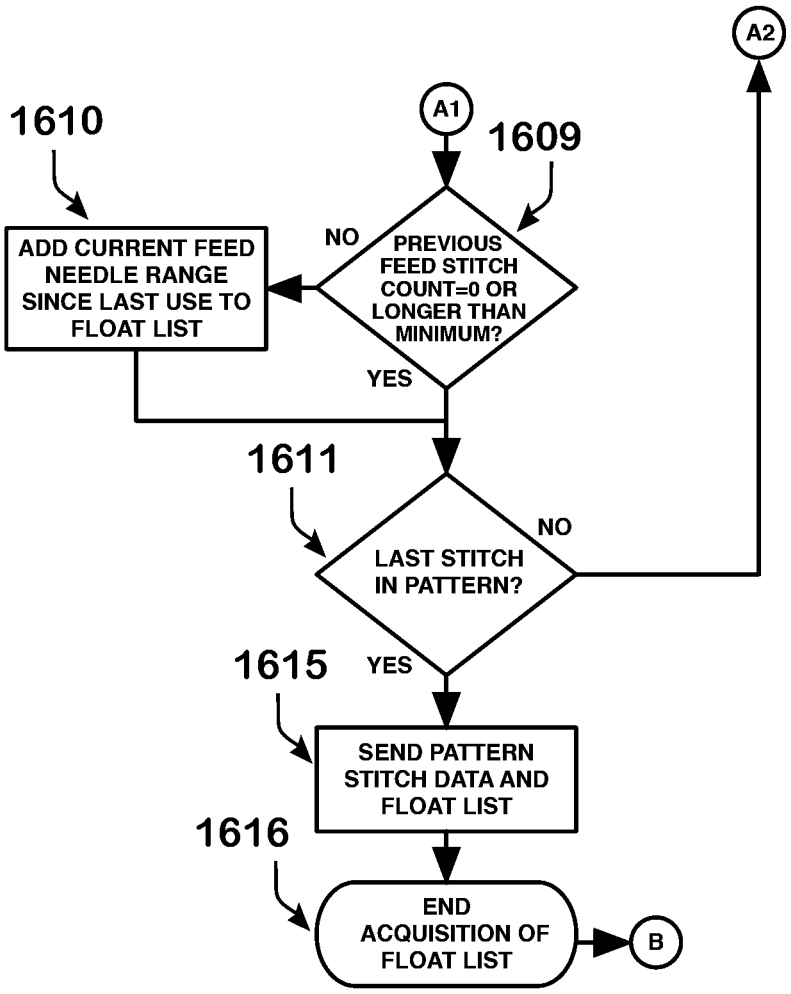

However, if decision operation 1609 in FIG. 16B finds that the feed stitch count for the previous stitch to be greater than zero and less than the minimum number of stitches needed to avoid creating a float thread, this indicates a float thread will be created by the most recent use of the previous feed. Decision operation 1609 branches to "no" and adds information about the sequence of stitches for the previous feed to the float list in step 1610. This information will include the previous yarn feed number, and enough data to allow subsequent processes to determine which stitches constitute the float thread (i.e., either the starting and ending stitch numbers knitted by the previous yarn feed or the list of contiguous stitch numbers knitted by the previous yarn feed).

Figure 17A:
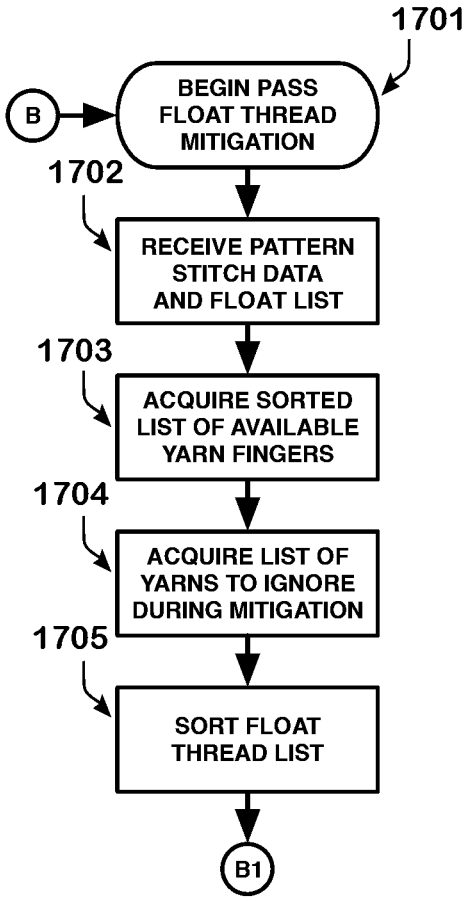

Continuing to FIG. 17A, the present method begins a pass 1701 through the pattern stitch data and float list to mitigate float threads. The present method is given starting data including pattern stitch data and the list of float threads in step 1702. In addition, it is supplied the list of available yarn fingers, sorted in the preferred order of use in step 1703. If there are any yarn fingers that should be allowed to form float threads, perhaps because the yarns being employed are sufficiently elastic not to need any float threads removed, they are identified in step 1704.

Figure 11:
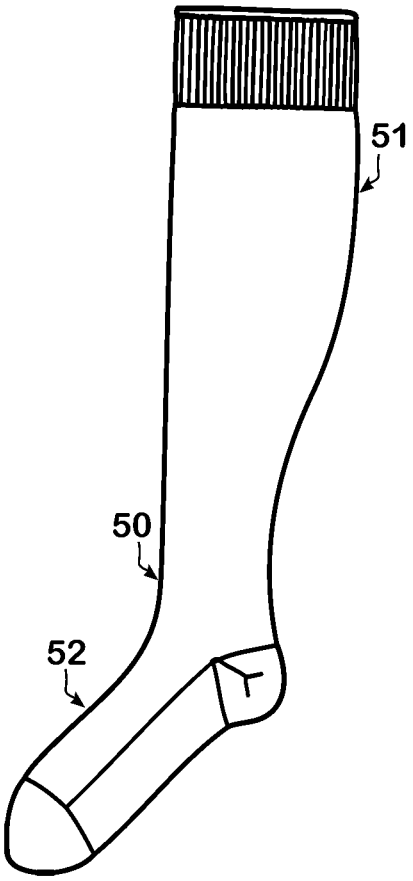
FIG. 11 is a diagram illustrating the relative magnitude of fabric stretch required in various areas of a hypothetical garment.

In step 1705, the list of float threads is sorted to determine the order in which it will attempt to mitigate the float threads. The sorting process will be dictated by the complexity of the pattern being knitted and the limits placed on feed resources available for the mitigation process. A starting point for sorting is to start at the top of the pattern, and attempt to mitigate the longest float threads in each course of a pattern before shorter float threads in that specific course. Alternatively, to use limited feed resources more effectively, it may be desirable to sort the longest floats anywhere in the pattern before shorter float threads. The sort order may also take into account the stretch characteristics of specific yarns, attempting to mitigate the longest float threads of less elastic yarns before equal-length threads of more elastic yarns. Yet another possibility is shown in FIG. 11, which illustrates various needs for fabric stretch in different parts of a garment. In the illustrated sock, the leg of the sock 51 requires more stretch in the fabric than does the foot 52 or ankle 50. In this scenario, mitigating float threads in the sock leg may be of higher priority than those in the ankle, even if the float threads are the same length.

Figure 17B:
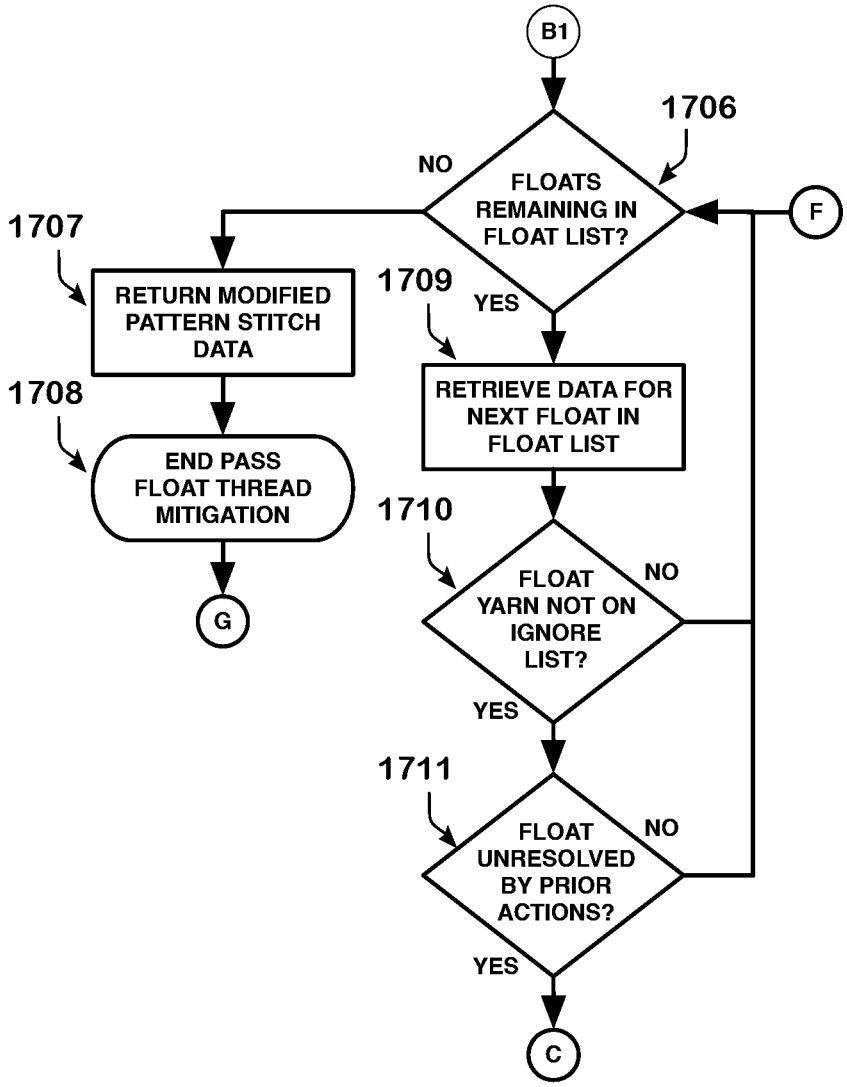

Continuing to FIG. 17B, the present method enters the main loop of the float mitigation process at decision operation 1706. If there are no floats remaining in the float list, the present method will return the modified stitch pattern data (step 1707) and end this pass of the float thread mitigation process (step 1708).

If decision operation 1706 determines there are floats remaining in the float list, the present method continues, retrieving stitch data for the next float in the list in step 1709. Two tests are made, by decision operations 1710 and 1711. If the yarn for the current float thread is listed as one to be ignored in step 1710, processing returns to decision operation 1706 for the next float. It is also possible that a prior change to the pattern feed data in this mitigation pass has eliminated the potential for a float thread to be created at the stitches documented by the data in the current float thread. In this case, decision operation 1711 will return processing to decision operation 1706 for the next float thread.

Figure 18A:
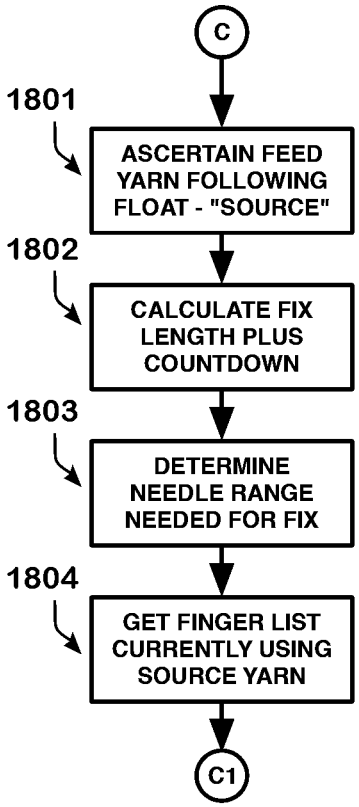
Figure 18B:
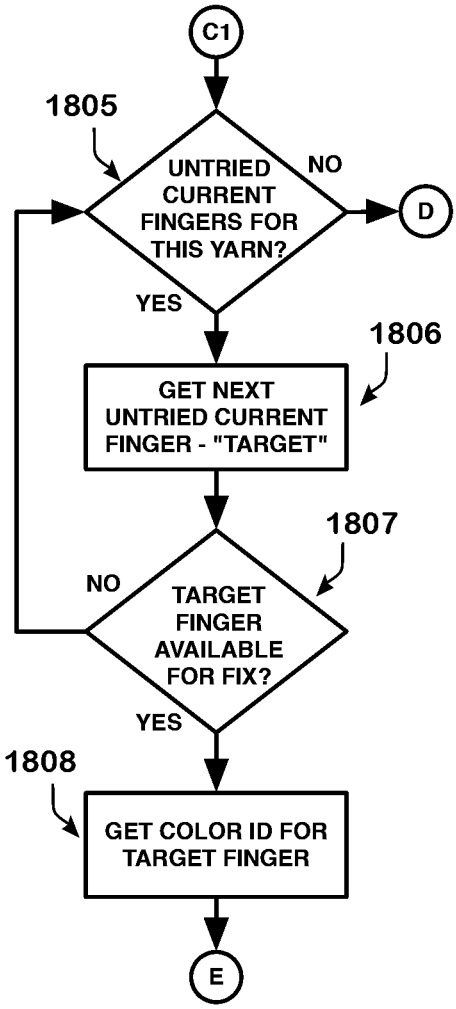

Continuing with FIG. 18A, the present method now follows the data process described in the examples illustrated in FIGS. 13, 13A and 14. Operation 1801 determines the yarn finger immediately following the float thread, referred to as the "source" finger. The length of usage of the source finger plus the countdown length dictated by the minimum number of stitches needed to avoid creating a float thread is calculated in step 1802. The needle range that must be available in another finger to mitigate the float thread is determined in step 1803 from the starting needle of the source finger and the calculated total length from step 1802. The present method gets a list of the yarn fingers using the same yarn as the source finger in step 1804. In FIG. 18B, decision operation 1805 determines if there are yarn fingers in use that have not been tested to see if they have sufficient space for the stitches from the source finger and the countdown range. Operation 1806, decision operation 1807 and decision operation 1805 in concert iterate through any yarn fingers in use for the source finger yarn, testing to determine if any of the fingers have sufficient space for the source finger stitches and countdown sequence.

Figure 19:
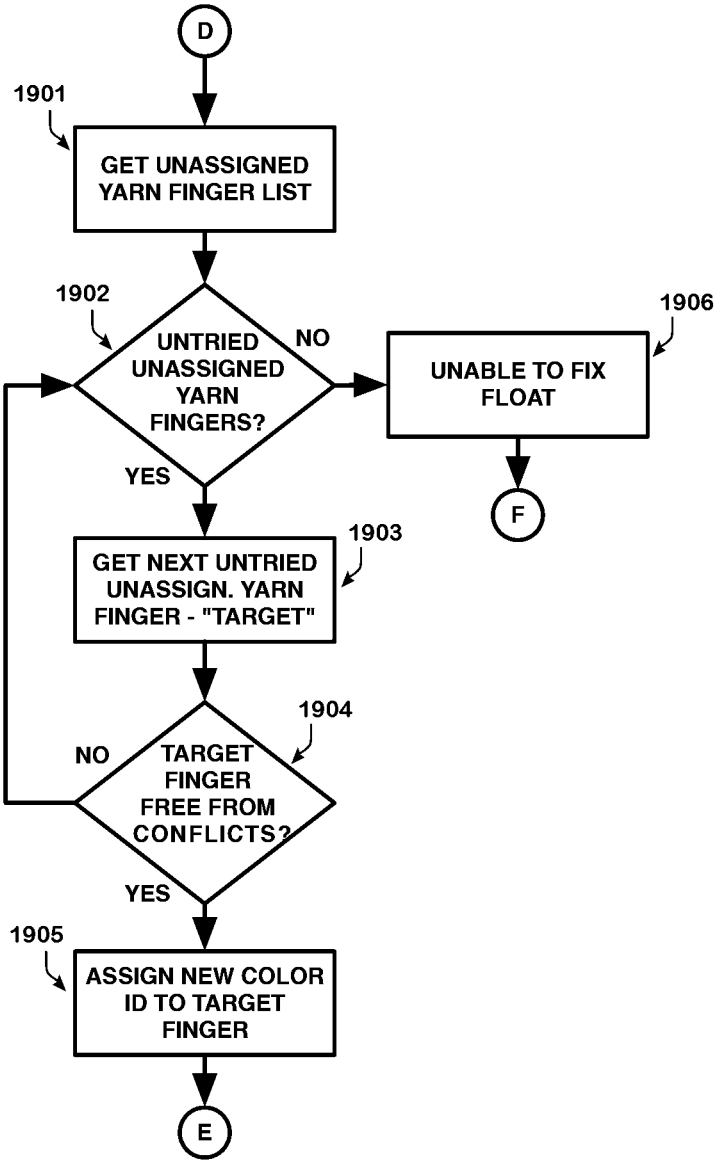

If none of the yarn feeds currently in use for the needed color have sufficient space, the present method continues in FIG. 19, retrieving the list of unassigned yarn fingers in step 1901. Even though a yarn finger is unassigned, it is possible that the finger cannot be used if the specific knitting machine for which a pattern is being developed imposes limitations on the number or order of feeds that can be used in a specific course. Decision operation 1902, operation 1903 and decision operation 1904 in concert iterate through any unassigned yarn feeds, to determine if there is an unassigned feed without any usage conflicts. If there are no untried, unassigned yarn fingers at decision operation 1902, the float cannot be fixed in step 1906, and the present method returns to step 1706 in FIG. 17B to retrieve the next float thread.

In FIG. 18B, if decision operation 1807 concludes that an already-in-use target finger is available to fix the current float thread, the present method retrieves the color identification character for the target finger. On FIG. 19, if decision operation 1904 concludes that a new target yarn finger is free from conflicts, a new color identification character is assigned to the target yarn finger.

Figure 20:
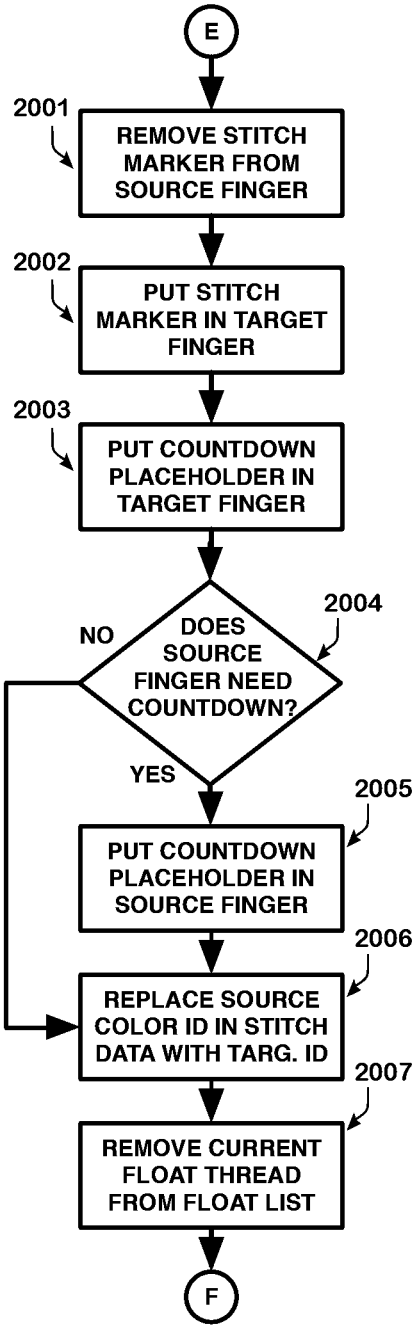

In either case, continuing with FIG. 20, the present method removes the stitch marker from the source finger data in step 2001, puts a stitch marker in the target finger data in step 2002, and places the countdown placeholder in the target finger data in step 2003. If the source finger requires a countdown sequence added to it or continued in step 2004, one is added in step 2005. Next, the source color identifier is replaced in the stitch data with the target color identifier in step 2006. Finally, data for the current float thread is removed from the float list in step 2007.

At this point, the present method returns to step 1706 in FIG. 17B for the next float thread in the float list. If all float threads have been processed, the present method returns the modified pattern stitch data in step 1707 and ends the float mitigation pass in step 1708. Returning to FIG. 15, step 1507 receives the revised pattern stitch data from the previous modules. Operation 1508 compares the newly received data to the prior copy of the stitch data, and if there has been no change in step 1509, ends the float analysis in step 1513. If the data has changed, and if the requested iteration count has not been reached in step 1510, the present method makes a new copy of the pattern stitch data and sends the current pattern stitch data in step 1601 of FIG. 16A for another pass (step 1512). If the requested iteration count has been reached in step 1510, the present method ends the float analysis in step 1513 of FIG. 15.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A method for reducing the occurrence of float threads in knitted fabric produced by a computer-controlled knitting machine having multiple yarn feeds controlled by a programmed pattern, in which yarns having specific characteristics in the fabric pattern are assigned to each of a set of yarn feeds with a number of the yarn feeds left unassigned, said method comprising:

building a list of float threads from the programmed pattern;

prioritizing the list of float threads based on at least one predetermined factor, including the length of each float thread; and modifying the programmed pattern based on the prioritized list of float threads to assign at least one unassigned yarn feed to use an existing yarn in the fabric pattern, to thereby reduce float threads.

2. The method of claim 1 further comprising iteratively repeating the following subsequent steps:

(a) rebuilding the list of float threads from the modified programmed pattern;

(b) prioritizing the list of float threads based on predetermined factors, including the length of each float thread; and (c) modifying the programmed pattern based on the prioritized list of float threads to assign at least one unassigned yarn feed to use an existing yarn in the fabric pattern, to thereby reduce float threads.

3. The method of claim 2 further comprising iteratively repeating steps (a) through (c) until no unassigned yarn feeds remain.

4. The method of claim 2 further comprising iteratively repeating steps (a) through (c) until no additional float threads can be mitigated.

5. The method of claim 2 wherein one unassigned yarn feed is assigned at step (c) in each iteration.

6. The method of claim 1 wherein the list of float threads is prioritized based at least in part on the location of the float thread within the knitted fabric.

7. The method of claim 1 wherein the list of float threads is prioritized based at least in part on the stretch characteristics of the yarn.

8. The method of claim 1 wherein the list of float threads is prioritized based at least in part on the yarn material.

9. The method of claim 1 further comprising providing a visualization of the float threads in the knitted fabric produced by the modified programmed pattern.

10. The method of claim 1 further comprising providing a histogram visualization of the degree of stretch reduced by float threads in the knitted garment produced by the modified programmed pattern.

11. A method for reducing the occurrence of float threads in knitted fabric produced by a computer-controlled knitting machine having multiple yarn feeds controlled by a programmed pattern, in which yarns having specific characteristics in the fabric pattern are assigned to each of a set of yarn feeds with a number of the yarn feeds left unassigned, said method comprising:

(a) building a list of float threads from the programmed pattern;

(b) prioritizing the list of float threads based on at least one predetermined factor, including the length of each float thread;

(c) modifying the programmed pattern based on the prioritized list of float threads to assign an unassigned yarn feed to use an existing yarn in the fabric pattern, to thereby reduce float threads; and (d) iteratively repeating steps (a) through (c) with the modified programmed pattern until no additional float threads can be mitigated, or until a predetermined number of iterations has been completed.

12. The method of claim 11 wherein the list of float threads is prioritized based at least in part on the location of the float thread within the knitted fabric.

13. The method of claim 11 wherein the list of float threads is prioritized based at least in part on the stretch characteristics of the yarn.

14. The method of claim 11 wherein the list of float threads is prioritized based at least in part on the yarn material.

15. The method of claim 11 further comprising providing a visualization of the float threads in the knitted fabric produced by the modified programmed pattern.

* * * * *